United States Patent [19]

Bonse et al.

[11] Patent Number: 4,905,645

[45] Date of Patent: Mar. 6, 1990

[54] SAFETY SYSTEM FOR INTERNAL COMBUSTION ENGINES

[75] Inventors: Bernhard Bonse, Stuttgart; Werner Fischer, Ditzingen; Gerhard Stumpp, Stuttgart, all of Fed. Rep. of Germany

[73] Assignee: Robert Bosch GmbH, Stuttgart, Fed. Rep. of Germany

[21] Appl. No.: 300,059

[22] Filed: Jan. 23, 1989

[30] Foreign Application Priority Data

Jan. 30, 1988 [DE] Fed. Rep. of Germany ..... 3802770

[51] Int. Cl.[4] ..... F02B 77/00

[52] U.S. Cl. ..... 123/198 D; 123/198 DB

[58] Field of Search ..... 123/198 D, 198 DB, 359, 123/479; 73/119 A

[56] References Cited

U.S. PATENT DOCUMENTS 3,841,291 10/1974 Ludewig et al. ..... 123/198 DB
4,088,110 5/1978 Sperline ..... 123/198 DB
4,515,125 5/1985 Buck et al. ..... 123/198 DB
4,597,369 7/1986 Yasuhara ..... 123/198 DB

*Primary Examiner*—Noah P. Kamen
*Attorney, Agent, or Firm*—Michael J. Striker

[57] ABSTRACT

To monitor the functioning of a redundant safety fuel shut off valve in a diesel engine, the electric power supply for a controlling device for the fuel quantity adjustor of a fuel injection pipe is decoupled from the power supply for the control of the electromagnetic fuel shut off valve. A relay controlled by a driving switch of the engine has a contact whose opening is time delayed relative to the opening of the driving switch. The relay contact is connected for energizing the controlling device for the fuel quantity adjustor whereas the energization and deenergization of the fuel shut off valve is effected immediately via a decoupling member. When the driving switch is opened and the engine is running during the given time delay interval, an error signal is generated indicating a malfunction of the fuel shut off valve.

8 Claims, 1 Drawing Sheet

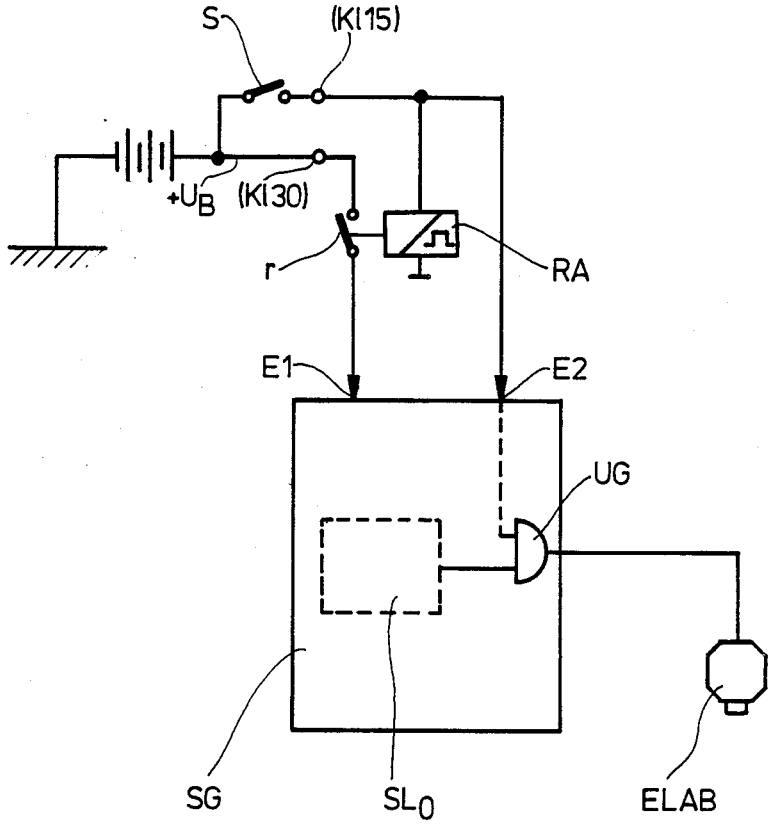
S
(Kl15)
+U_B
(Kl30)
r
RA
E1
E2
UG
SG
SL_0
ELAB

SAFETY SYSTEM FOR INTERNAL COMBUSTION ENGINES

BACKGROUND OF THE INVENTION

The present invention relates to a method of and a device for monitoring the function of a safety shut off device in the form of an electromagnetic fuel shut off valve (ELAB) in internal combustion engines, particularly in Diesel engines having an electrical power source, a driving switch, a fuel quantity adjustor acted upon by an electronic Diesel regulating and controlling device (EDC). The invention relates also to a device for carrying out the method.

In a known fuel injection pump for Diesel engines according to German publication DE-OS 2,945,484, a piston arranged in the housing of a fuel injection pump is brought into a reciprocating movement and simultaneously into a rotary movement whereby fuel flows from a suction chamber formed within the pump housing toward the pump piston. From the injection pump, the adjusted quantity of fuel is supplied into pressure conduits leading to cylinders of the Diesel engine. In a connection conduit between the suction chamber and an intake of the pump piston, a safety valve is provided which interrupts the fuel flow from the suction chamber when certain predetermined safety limit conditions are exceeded. For example, a safety limit condition is exceeded when a control lever is adjusted by the gas pedal into its idling position and the delivery pressure in the housing of the fuel injection pump corresponds to a higher rotary speed than that required for an idling operation.

Another known emergency control device for a fuel metering system for use in Diesel engines (DE-OS 3,238,191) includes an emergency control branch which is manually or automatically connectable parallel to a signal processing device having a regulating device for the fuel supply. The emergency control branch is provided with a load pressure regulator and its output signal in the event of an interference is applied by an interference detecting circuit to an adjusting mechanism which delivers to the internal combustion engine the requisite quantity of fuel depending on the mode of operation. To take into account further operational conditions, a minimum value selection circuit can be provided in the emergency control branch.

From the DE-S 1,962,570 a resetting device for a fuel quantity determining member of a fuel injection system of a Diesel engine is known, which becomes activated when an error condition occurs, for example when the regulating circuit itself or a connection to corresponding sensors is interrupted. As a consequence, in the event of a failure the fuel quantity determining member is adjusted for the delivery of small quantities of fuel to be injected. In this known solution where the fuel quantity is metered toward small values, the power output of the internal combustion engine can be reduced to such an extent that, for example during operation in a difficult terrain, the running of the engine can no longer be sustained.

Generally known are also electronic adjusting circuits for regulating the operation of self-igniting internal combustion engines, i.e. Diesel engines. For example, according to DE-OS 3,531,198 an electric adjusting device controlled by electrical signals is known whereby instead of mechanical fuel measuring and regulating systems a central control apparatus (SG) generates the requisite adjusting signals. It is true that mechanical fuel metering systems in Diesel engines are reliable with regard to their safety against errors, nevertheless under circumstances they increasingly fail to be compatible with the requirement to take into account a large number of different operational and environmental conditions.

The application of electronic components in connection with an electronic Diesel regulation (EDC) makes it desirable to employ comprehensive safety, monitoring and emergency measures inasmuch as the individual structural groups by themselves offer the possibility to recognize an error or to eliminate the error.

From DE-OS 3,301,742 it is known to provide a safety device for a self-igniting internal combustion engine with means for the continuous generation of signals corresponding to operational variables of the engine such as gas pedal position, computed desired value of a control rod travel, rotary speed, brake pedal position and the like and to determine by means of a minimum value selection a corrected desired value of the control rod displacement and apply the same to the setting regulator of the controlling device (EDC). This corrected desired value of the control rod displacement serves simultaneously for the determination of a deviation of the regulation from the sensed actual value of the control rod displacement. Upon exceeding predetermined limits the known safety device then reacts either by inactivating the fuel injection pump, deenergizing the end stage or the setting regulator or by introducing an emergency mode of operation. However, with this known safety device problems may occur under certain circumstances inasmuch as all possible marginal conditions are not considered during the determination of the safety conditions. For instance, by the provision of an idle speed contact on the gas pedal it is possible to obtain an idling indication signal. However, this indication signal is of no effect when the engine is equipped with a driving speed regulator, for example. Moreover, it is conceivable that during sport driving, or in order to warn tailgating drivers at high driving speeds, and the like, a driver may for a short time activate or just touch the brake pedal while the gas pedal remains depressed or is not yet in its idling position.

Considering the importance of an electromagnetic shut off valve (ELAB) which acts as a redundant safety shut off member in internal combustion engines to shut off the engine in the case of interference by interrupting the fuel supply, it is desirable to continuously monitor the correct functioning of the electromagnetic shut off valve.

Under normal operational conditions the electronic Diesel regulating and control device (EDC) is capable of detecting a defect in the fuel quantity adjusting mechanism substantially on the basis of a lasting regulating deviation in the adjustment regulating circuit. The controlling device (EDC) then activates via a suitable safety logic circuit the electromagnetic shut off valve to interrupt the fuel supply. Accordingly, the electromagnetic shut off valve (ELAB) acts as a safety member which is able to guarantee a shut off of the engine also in the case of a jammed fuel quantity adjusting mechanism or a short circuited end stage in the EDC-control device, for example. Hence, due to the importance of the shut off safety valve (ELAB) a continuous monitoring of its function is unconditionally necessary. Due to the fact that the fuel shut off safety valve (ELAB) itself is a component part of the fuel metering device similarly as all other components of the system and therefore cannot be tested separately as to its function, difficulties are encountered when it is desirable to continuously test its function because its proper functioning causes the stoppage of the engine. Therefore, the requirement or the possibility to test the operability of the ELAB valve in predetermined time intervals during normal operation of the vehicle cannot be met because of driving safety, inasmuch as the testing would cause a temporary stoppage of the engine.

In addition, a defect in the ELAB valve cannot be recognized by the operator because during the switch off of the power supply the defective ELAB is deenergized and of course power for the fuel quantity adjusting mechanism and other components is also disconnected. Moreover, it cannot be assumed that the driver or the user of the vehicle which is equipped with such a monitoring system would continuously keep in mind or be willing to test a specific safety components in the fuel regulating system of his or her vehicle.

SUMMARY OF THE INVENTION

It is therefore a general object of this invention to overcome the aforementioned disadvantages.

More particularly, it is an object of the invention to provide an improved monitoring system for the safety fuel shut off valve (ELAB) which can be regularly tested as to its functionability and can be unavoidably tested by the user of the vehicle during each switching off or stopping of the engine, for example.

In keeping with these objects and with others which will become apparent hereinafter, one feature of this invention resides in a method in which during the switch off or stoppage of the internal combustion engine the electronic Diesel regulating and controlling device (EDC) together with the fuel quantity adjustor controlled by it is disconnected with a time delay from its power source, and by monitoring the transient activity of the engine, such as its immediate stoppage or continuation of its running during or after its switch off, a malfunction of the safety shut off valve (ELAB) can be determined.

In a device embodying this invention, upon switching off a driving switch through which the controlling device (EDC), the fuel quantity adjustor as well as the safety shut off valve (ELAB) are energized, a time delaying member disconnects the energization of the electronic Diesel regulating and controlling device (EDC) with a predetermined time delay after the disconnection of the electromagnetic safety shut off valve (ELAB). With a correctly functioning shut off valve the engine stops practically immediately within a short time interval of about 1 second whereas if the shut off valve is defective the engine comes to standstill after the predetermined time delay from the instant when the energization of the electronic Diesel controlling device (EDC) is interrupted.

Due to the decoupling of the power supply of the electronic Diesel regulating and controlling device (EDC) (and of the fuel quantity adjustor) from the power supply of the electromagnetic safety shut off valve (ELAB), a continuous monitoring of the function of the safety valve is guaranteed.

This reliable and simple solution of the aforementioned monitoring problem is achieved with a very small additional expense by decoupling the power supplies and by the provision of a timing relay connected in series with the driving switch to deenergize with a predetermined time delay the controlling device (EDC). It is also of advantage to provide an AND gate either in the hardware of the controlling device (EDC) or by means of software (in a corresponding control program) in order to evaluate the defect detected during the test.

It is also advantageous in systems provided with a storage for detected errors to indicate during a subsequent drive a detected malfunction of the ELAB to the driver either by a warning lamp or by a corresponding influencing of the driving quality or performance of the vehicle, for example by reducing the amount of injected fuel or by reducing the maximum rotary speed.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE illustrates schematically a circuit for carrying out the method of this invention.

DESCRIPTION OF THE PREFERRED EMBODIMENTS

The essence of this invention resides in the decoupling of energization of the controlling device (EDC) for the electronic Diesel regulator and the associated fuel quantity adjustor, from the energization of the electromagnetic safety member ELAB such that after the disconnection of the electric power supply the ELAB is deenergized earlier than the controlling device (EDC). Accordingly, the assumed basic function of the electromagnetic safety member ELAB namely to allow a free flow of fuel in the engine during its energization but to interrupt the fuel supply when deenergized, can be tested. The time delay of the deenergization of the EDC with respect to ELAB amounts only to several seconds which however suffice to reliably test the ELAB for its correct function. Due to the premature disconnection of the ELAB from the electric power source the engine would stop practically immediately. This can be detected by suitable sensors. If the engine stoppage does not occur the electromagnetic safety member is defective.

The drawing illustrates one of possible embodiments of a device for carrying out the method of this invention. The illustrated component parts and circuit blocks can be realized by an analog, digital- or a hybrid technology or their functions can be totally or partially performed by a suitable program control of a digital system such as for example a microprocessor, microcomputer, or other suitable combination of digital and analog logic circuits operating according to a stored program.

In the illustrated embodiment, the (EDC) controlling device SG controls, among other devices which need not be described in detail for the purposes of this invention, an electronic Diesel regulator which acts upon a fuel quantity adjustor. The controlling device SG also includes a safety logic subcircuit SLo including a large number of sensors for detecting operational variables of the engine and is coupled to an input of an AND gate UG whose output is connected to a redundant safety member in the form of the electromagnetic safety fuel shut off valve ELAB.

The (EDC) controlling device SG has two power supply inputs E1 and E2 of which the input E1 serves for the energization of the electronic Diesel regulator inclusive of the non-illustrated fuel quantity adjustor. The other power supply input E2 is connected to the other input of the AND gate UG to control the energization of the electromagnetic fuel shut off valve ELAB. The two power supply inputs E1 and E2 are decoupled from one another by a decoupling relay RA actuating with a given time delay a switching contact r by means of which the power supply input E1 is connectable to a terminal K1 30 to which a plus pole of a power supply battery $U_B$ is connected. The other power supply input E2 together with an energizing coil of relay RA are connected to terminal K1 15 which is connectable to the plus pole of the battery $U_B$ via a driving switch S. At the beginning of a drive of the motor vehicle, the driving switch S is switched on and at the end of the drive the switch S is switched off to deenergize the relay and the control AND gate UG for the ELAB. As mentioned before, the relay contact r opens with a time delay after the deenergization of the relay coil RA by means of the driving switch S.

In this embodiment, the control AND gate UG energizes the electromagnetic fuel shut off valve ELAB when the voltage of battery $U_B$ is present at the power supply input E2 and the logic control circuit SLo has a high logic state at its output. The high condition at the output of Slo occurs when correct functions of other circuit components are detected by the logic control circuit. Accordingly, when a high signal is applied to both inputs of the AND gate UG, the output of the AND gate delivers an energizing current to the electromagnetic shut off valve ELAB so that its valve member is brought into its activated condition in which it releases the flow of fuel into the engine.

Consequently, when opening or switching off the drive switch S, the terminal K1 15 and hence via the input E2 the corresponding input of the AND gate UG are brought to low state and the electromagnetic shut off valve ELAB is deenergized so that—assuming a correct function—it immediately interrupts the fuel supply to the engine.

At the same time, due to the time delayed action of the relay RA, the contact r remains closed for a given time interval (1 second to several seconds) and accordingly the (EDC) controlling device SG together with the fuel quantity adjustor remain connected for this time interval to the terminal K1 30 of the power supply $U_B$. Due to the deenergization of the electromagnetic fuel shut off valve ELAB the fuel supply is interrupted and the engine of necessity stops within a short time interval which may amount for example to 1 second. With resulting zero rotary speed a signal generated by a needle movement sensor (a sensor arranged at the fuel injection nozzle to generate an input signal for the control circuit) disappears.

If the signal from the needle movement sensor is present, this is an indication of seizing or jamming in the electromagnetic shut off valve or a defect in its energization. In this case a control circuit can recognize this malfunction inasmuch as the engine keeps running and is not stopped by the action of the shut off valve ELAB. The control circuit then can generate an error signal. It will be understood that after the time delayed opening of the contact r on the delay RA the engine is stopped in conventional manner by the (EDC) controlling device via the fuel quantity adjustor.

In further modifications of this invention, it is possible to equip the (EDC) controlling device SG with a storage for the error signal which has been generated after the detection of a malfunction of the shut off valve ELAB. After the next start the error indication is repeated and if desired the error indication can be supplemented by the reduction of the amount of injected fuel or by the reduction of maximum rotary speed. Through the logic coupling (AND gate UG) of the output of the logic control circuit SLo which in conventional control devices energizes the electromagnetic safety shut off valve ELAB, with the second power supply input E2 (or terminal K1 15 which is connectable to the electric power supply by a driving switch S), the known systems can be readily modified either by hardware within the control apparatus or by means of software outside the control apparatus. Hence, the invention enables a simple and reliable solution of the detection of a malfunction and a continuous monitoring of correct operation of a redundant electromagnetic safety member whose function or malfunction has hitherto been undetectable during a normal driving operation of a motor vehicle where the interruption of the fuel supply has been controlled exclusively by the EDC-controlling device via the fuel quantity adjustor.

While the invention has been illustrated and described as embodied in the form of hardware circuits, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of monitoring the function of a redundant safety member in the form of an electromagnetic fuel shut off valve (ELAB) in international combustion engines, particularly in Diesel engines having an electric power source, a fuel quantity adjustor acted upon by a Diesel regulator, an electronic controlling device (SG) for controlling the Diesel regulator and the ELAB whereby in the event of a failure the safety member is controlled to interrupt fuel supply to the engine, and switching means for controlling the electric power supply to switch on or off the engine, comprising the steps of delaying for a given time interval the deenergization of said SG and said Diesel regulator with each disconnection of said ELAB from the power source when the switching means is switched off; and observing transient activity of the engine to detect a malfunction of the ELAB.

2. A method as defined in claim 1, wherein in the case of a malfunction of the ELAB the engine keeps running after said given time interval and an error signal is generated by said SG whereas in the case of a correct function of the ELAB the rotary speed of the engine drops to zero within said time interval.

3. A method as defined in claim 2, wherein said error signal is stored in a store and after the next start of the engine is employed for influencing operational variables of the engine for example by reducing the amount of injected fuel or by reducing the maximum rotary speed of the engine to indicate to the driver a malfunction of the ELAB.

4. A device for monitoring the function of a redundant safety member in the form of an electromagnetic fuel shut off valve (ELAB) in international combustion engines, particularly in Diesel engines having an electric power source, a fuel quantity adjustor acted upon by a Diesel regulator, an electronic controlling device (SG) for controlling the Diesel regulator and the ELAB whereby in the event of a failure the safety member is controlled to interrupt fuel supply to the engine, and switching means for controlling the electric power supply to switch on or off the engine, comprising means for decoupling the energization of said ELAB from said SG, Diesel regulator and fuel quantity adjustor, said switching means including a drive switch for energizing and deenergizing said ELAB, and a time delayed switch for deenergizing said SG, Diesel regulator and fuel quantity adjustor after a given time interval when the drive switch deenergizes via said decoupling means said ELAB.

* * * * *